United States Patent [19]

Sweeney

[11] 4,397,655

[45] Aug. 9, 1983

[54] NOVEL PROCESS FOR PREPARING DIESEL FUEL

[75] Inventor: William M. Sweeney, Wappingers Falls, N.Y.

[73] Assignee: Texaco Inc., White Plains, N.Y.

[21] Appl. No.: 267,199

[22] Filed: May 26, 1981

[51] Int. Cl.[3] ..... C10L 1/18

[52] U.S. Cl. ..... 44/66; 44/53; 44/77

[58] Field of Search ..... 44/53, 57, 66, 77

[56] References Cited

U.S. PATENT DOCUMENTS

| | | | |
|---|---|---|---|
| 1,420,622 | 6/1922 | Charbonneaux | 44/66 |
| 2,117,609 | 5/1938 | Jean | 44/53 |
| 2,878,109 | 3/1959 | Wood et al. | 44/77 |
| 4,261,702 | 4/1981 | Sweeney et al. | 44/56 |

*Primary Examiner*—Jacqueline V. Howard

*Attorney, Agent, or Firm*—Carl G. Ries; Robert A. Kulason; Carl G. Seutter

[57] ABSTRACT

A vegetable oil such as soy bean oil, extended by addition of ethanol, may be stabilized against phase separation or haziness in the event of water contamination at pH below 7 by addition thereto of additives such as 2,2-dimethoxy propane.

35 Claims, No Drawings

NOVEL PROCESS FOR PREPARING DIESEL FUEL

FIELD OF THE INVENTION

This invention relates to the stabilization of extended vegetable oils against phase separation on contact with water.

BACKGROUND OF THE INVENTION

As is well known to those skilled in the art, vegetable oils such as soy bean oil are available in substantial quantity; and they are used in a wide range of industries. It has been found that it may be desirable to extend these oils by addition of diluents which are miscible with the oils. Typical of such extenders are ethanol and in many cases isopropanol.

It is found that extended vegetable oils prepared for example by addition of eg ethanol to soy bean oil are stable when anhydrous (i.e. containing less than about 0.01 w % water); they undesirably form two phases at temperatures of 20° C.–30° C. when contacted with water in amount greater than about 0.2 w %.

It is an object of this invention to provide a novel process for stabilizing a composition containing an ethanol-miscible vegetable oil. Other objects will be apparent to those skilled in the art.

STATEMENT OF THE INVENTION

In accordance with certain of its aspects, this invention is directed to a method of stabilizing a composition containing an ethanol-miscible vegetable oil and a water-miscible alcohol which is miscible with said vegetable oil whereby said composition is inhibited from separating into more than one layer on contact with water which comprises mixing (i) said composition containing an ethanol-miscible vegetable oil and a water-miscible alcohol which is miscible with said vegetable oil, and (ii) as an additive, a ketal or an acetal or an orthoester thereby forming a stabilized composition of increased water-tolerance which remains a single phase mixture of pH below 7 in the presence of water; and recovering said stabilized composition of increased water-tolerance.

DESCRIPTION OF THE INVENTION

The ethanol-miscible vegetable oils which may be treated by the process may include a wide range of lipids which are liquid at ambient temperatures typically because of a high content of olefinic acid components. These oils may include acids or esters. The vegetable oils may include the following oils:

TABLE

| |
|---|
| coconut |
| babasu |
| palm kernel |
| palm |
| olive |
| castor |
| peanut |
| rape |
| cottonseed |
| corn |
| soy bean |
| oiticica |
| tung |
| linseed |
| perilla |

The preferred soy bean oil may be a mixture of fatty acids typically containing the following:

TABLE

| Acid | w % |
|---|---|
| palmitic | 6.5 |
| stearic | 4.2 |
| oleic | 33.6 |
| linoleic | 52.6 |
| linolenic | 2.3 |

It is preferred that such oils be substantially anhydrous i.e. that they contain less than about 0.01 w % water. Typically soy bean oil is available containing less than about 0.01 w % water.

An ethanol-miscible vegetable oil is one which will form a clear single phase mixture when up to 15 parts of ethanol are added to 100 parts of oil. The noted vegetable oils may be extended preferably by addition thereto of ethanol or n-propanol or isopropanol, preferably ethanol. These absolute (i.e. anhydrous) alcohols containing less than about 0.01% water, may be added to 100 parts of vegetable oils in amount of 1–15 parts, preferably 8–12 parts at 15° C.–30° C., say 20° C. to form liquids which are clear single phase mixtures. These mixtures may be used for many of the same purposes for which the unextended vegetable oils may be employed. In the absence of water, these mixtures may remain single phase mixtures.

It is found however that in the presence of water, these extended mixtures separate into two phases. Depending upon the particular oil and the alcohol, the amount of water, or the temperature, the mixture may form a haze or it may separate into a visible water layer and a non-aqueous layer.

It is a feature of the process of this invention that the vegetable oil-alcohol mixture may be stabilized against the hazing or separation into two phases by the addition thereto of an effective amount of, as additive, at least one ketal, acetal, or orthoester. Although it is possible to utilize mixtures of these additives, it is found in practice that use of a single additive may frequently be sufficient.

The ketal may be characterized by the formula $R_2C(OR')_2$; the acetal may be characterized by the formula $RCH(OR')_2$; and the orthoester may be characterized by the formula $RC(OR')_3$.

In the above compound, R or R′ may be a hydrocarbon radical selected from the group consisting of alkyl and cycloalkyl, including such radicals when inertly substituted. When R is alkyl, it may typically be methyl, ethyl, n-propyl, iso-propyl, n-butyl, l-butyl, sec-buty, amyl, octyl, decyl, octadecyl, etc. When R is cycloalkyl, it may typically by cyclohexyl, cycloheptyl, cyclooctyl, 2-methylcycloheptyl, 3-butylcyclohexyl, 3-methylcyclohexyl, etc. R may be inertly substituted i.e. it may bear a non-reactive substituent such as alkyl, cycloalkyl, ether, halogen, etc. Typically inertly substituted R groups may include 3-chloropropyl, 2-ethoxyethyl, carboethoxymethyl, 4-methyl cyclohexyl, etc. The preferred R groups may be lower alkyl, i.e. $C_1$–$C_{10}$ alkyl, groups including eg methyl, ethyl, n-propyl, i-propyl, butyls, amyls, hexyls, octyls, decyls, etc. R may preferably be methyl. R′ may preferably be methyl or ethyl.

In the preferred embodiment, R and R′ may be lower alkyl i.e. $C_1$ to $C_{10}$ but more preferably $C_1$ to $C_4$ alkyl. Illustrative ketals may include:

TABLE

| |
|---|
| 2,2-dimethoxy propane |
| 2,2-dimethoxy pentane |
| 2,2-dimethoxy butane |
| 3,3-dimethoxy pentane |
| 2,2-diethoxy propane |
| 2,2-di(cyclohexoxy) propane, etc. |

Illustrative acetals may include:

TABLE

| |
|---|
| di-methoxy methane |
| 1,1-di-methoxy propane |
| 1,1-diethoxy propane |
| 1,1-dipropoxy propane |
| 1,1-dimethoxy-n-butane |
| 1,1-diethoxy-n-butane |

Illustrative orthoesters may include:

TABLE

| |
|---|
| ethyl orthoformate |
| methyl orthobutyrate |
| n-propyl orthoacetate |

In practice of this invention according to one embodiment of the process of this invention, the additive ketal or acetal or orthoester may be added to the extended vegetable oil composition when the composition is prepared or shortly thereafter. In this manner, the additive will prevent formation of two phases.

In another embodiment, the additive ketal or acetal or orthoester may be added after the composition has separated into more than one phase because of the presence of water. In this manner, the additive will permit formation of a single phase from the multiphase mixture.

It will be clear to those skilled in the art that the amount of additive employed will be a function of the amount of water which is reasonably expected to be present. It is observed that typically a mixture of vegetable oil (90 v %) and absolute ethanol (10 v %) will not form two phases until the amount of water added is about 0.5 v %; and accordingly the amount of additive may be determined to take into account percentages of water above that level. Commonly, satisfactory results are obtained if the molar amount of additive is at least equal to (preferably 5%–10% greater than) the molar amount of water to be reasonably expected. In practice, this indicates that the additive be present in amounts of 1 v %–25 v %, preferably 1 v %–10 v %, say ca 1 volume percent of the composition. An illustrative composition may contain 90 volumes of soy bean oil, 10 volumes of absolute ethanol, and 1 volume of 2,2-dimethoxy propane. Another illustrative composition may contain 64 volumes of soy bean oil, 17 volumes of absolute methanol, and 1 volume of 2,2-dimethoxy propane.

It is a feature of the process of this invention that, in the presence of acid catalyst, the ketal or acetal or orthoester reacts with the water present to form alcohols.

The acid catalyst which may be employed in small-to-trace amounts may be an inorganic acid such as sulfuric acid, hydrochloric acid, etc. or an organic acid such as the strong acid p-toluene sulfonic acid etc. Typically such acids may be employed in amount of 0.0001 v %–1 v %, preferably 0.001 v %–0.1 v %, say 0.05 v % of the total composition. Concentrated sulfuric acid, in amount of 10 ppm, has been found to be satisfactory. Acid salts may be employed.

It is a particular feature of the process of this invention that it may be possible to use solid acid composition bearing protons to catalyze the reaction of water with ketal or acetal or orthoester. Typical of such solid acids are resins such as reticular sulfonated styrene-divinyl benzene copolymerization exchange resins typified by the Rohm and Haas Amberlyst 15 having a hydrogen ion concentration of 4.9 meq per gram of dry resin and a surface area of 42.5 square meters per gram.

The acid catalyst is commonly employed in catalytic amount sufficient to produce in the aqueous phase a pH low enough to catalyze the reaction of acetal or ketal or orthoester with water: typically a pH below 7 and commonly 1–6.5. Preferred range may be above about 5 and below 7 in the aqueous phase.

It may be noted that it is preferred, although not necessary to have acid present. If one is formulating a single phase composition such as dry vegetable oil and absolute alcohol, it may be possible to maintain this in single phase by addition of the requisite amount of ketal or acetal or orthoester. The acid which catalyzes the reaction of the ketal or acetal or orthoester with water may be present in the various containers or conduits through which the composition passes. However if the composition already contains substantial water or if it has already exceeded the solubility limit and has separated into two phases then it is preferred to accelerate the reaction by addition of acid.

In carrying out the process of this invention to stabilize a composition containing a liquid vegetable oil and a water miscible alcohol which is miscible with the hydrocarbon, it may be desirable to add ketal or acetal or orthoester and the acid, typically a liquid acid, directly to the composition and to agitate the mixture. This will provide a single phase mixture and when the additive is present in amount greater than that necessary to react with the water present, it will also provide protection against the formation of two phases when the mixture is later brought into contact with water.

If the composition has been contacted with, or otherwise contains enough water to permit formation of more than one phase, it may be desirable to add the ketal or acetal or orthoester and the acid and to agitate the mixture. In this instance, it may be desirable for example to suspend, in the agitated mixture of composition plus acetal or ketal or orthoester, porous bags or baskets of solid acid such as resin pellets in acid form.

The stabilized compositions may be found to be stable over an extended period of time and, when mixed with adequate proportions of ketal or acetal or orthoester, may be stable in the presence of unexpectedly large quantities of water.

It appears that the ketal or acetal or orthoester may function by reacting with the water in the presence of catalytic amounts of acid thereby forming alcohols. Thus the additives remove the water and also form alcohols which are miscible with the composition. When the additive contains methyl or ethyl groups, the resultant alcohols formed are methanol and ethanol.

It is a feature of this invention that it may be found to be particularly satisfactory when the mixture of vegetable oil, alcohol, and additive is to be used as a synthetic diesel fuel. A typical mixture useful as synthetic diesel fuel may contain 90 volumes of soy bean oil, 10 volumes of absolute ethanol, and 2.0 volumes of 2,2-dimethoxy propane additive. It will be apparent to those skilled in the art that the synthetic diesel fuels of this invention may contain other additives typified by anti-oxidants (such as hindered phenols eg 2,6-di-t-butyl phenol; tocopherols; etc).

The fuel so prepared may be found to be stable against contact with water at pH below 7 during subsequent handling; and it is found to possess desirable characteristics of a diesel fuel.

TABLE

| Property | Diesel Fuel D-1 | Typical Synthetic Formulation |
|---|---|---|
| Cetane Number | 43 | 35 |
| Density | 0.8 | 0.92 |
| Flash Point °F. | 140 | 80 |

It will be clear from the above table that the synthetic formulations of this invention possess proper characteristics to be useful as a diesel fuel, and when prepared with an excess of eg ketal, they are properly "buffered" to remain stable (i.e. single phase free of haze) at ambient temperature in the presence of water at pH below 7.

These novel compositions may be used in substantially the same manner as the unstabilized vegetable oils may be used; and they may be found to be particularly useful as diesel fuels. A preferred synthetic diesel fuel, that prepared from 90 volumes of soy bean oil, 10 volumes of absolute ethanol, and 2 volumes of 2,2-dimethoxy propane may be found to be useful as diesel fuel before being contacted with water—or after contact with water in amount equivalent to the ketal present at pH below 7.

Practice of the process of this invention may be apparent to those skilled in the art from the Examples which follow wherein, as elsewhere in this application, unless otherwise stated all parts are parts by weight.

DESCRIPTION OF PREFERRED EMBODIMENTS

In Examples I–II, the soy bean oil used is the Welch, Holmes, and Clark brand of soy bean oil having the following properties:

TABLE

| Property | |
|---|---|
| Density | 0.9231 |
| Kin Vis 40° C. | 31.3 |
| 100° C. | 7.62 |
| Cloud Point °F. | +20 |
| Pour Point °F. | +15 |
| $n_D^{20}$ | 1.4745 |
| Sap. No. | 190.2 |

In this Example, 90 volumes of soy bean oil are mixed with 10 volumes of absolute ethanol and with 0.3 volumes of water. This causes separation into a two phase mixture and formation of a haze. To 100 volumes of this composition there is added 2,2-dimethoxy propane (2.00 volumes), corresponding to 1.036 moles thereof per mole of water present, and 0.5 parts of Amberlyst 15 catalyst—a divinylbenzene-cross-linked sulfonated polystyrene in acid form. After agitation for a short period, the haze disappears; and the composition exhibits a single phase. This is retained after standing overnight and also after heating to 100° F. over 20 minutes.

EXAMPLE II*

In this Control Example, the procedure of Example I is duplicated except that no Amberlyst 15 catalyst is added. The resultant mixture is hazy at all times.

EXAMPLE III*

In this Control Example, the procedure of Example II* is followed except that, in place of the soy bean oil corn oil was used. The particular corn oil (Welch, Holmes, and Clark brand) had the following properties:

TABLE

| Properties | |
|---|---|
| Density | 0.9231 |
| Kin. Vixc. 40° C. | 31.9 |
| 100° C. | 7.69 |
| Sap. No | 188.8 |
| Cloud Point °F. | +8 |
| Pour Point °F. | +5 |

The amount of 2,2-dimethoxy propane added corresponded to 0.689 moles per mole of water; and no Amberlyst is added.

The mixture exhibited a haze.

EXAMPLE IV*

In this Control Example, the procedure of Example III* is duplicated except that there is added 0.5 parts of Amberlyst 15 acid resin catalyst.

The results of these four Examples may be observed from the following Table.

EXAMPLES V–VI

In these examples, the same soy bean oil was used as in Examples I–II. The amount of 2,2-dimethoxy propane added corresponded to 0.689 moles per mole of water, as in Examples III–IV. The results are identical to those of Examples III–IV.

TABLE

WATER SEPARATION DATA OF SYNTHETIC DIESEL FUELS

| | I | II | III | IV |
|---|---|---|---|---|
| Vegetable Oil, Vol % | Soya, 90 | Soya, 90 | Corn, 90 | Corn, 90 |
| Ethanol, Vol % | 10 | 10 | 10 | 10 |
| Water added, %, Wt. | 0.3 | 0.3 | 0.3 | 0.3 |
| Appearance After Water Addition | Hazy | Hazy | Hazy | Hazy |
| Amount of 2,2-Dimethoxy Propane Mole Ratio of Water Added Above | 1.036 | 1.036 | 0.689 | 0.689 |
| Appearance after addition of DMP | Hazy | Hazy | Hazy | Hazy |
| Amberlyst 15, added, gm | 0.5 | — | 0.5 | — |
| Appearance after Amberlyst addition Overnight | Clear | Hazy | Hazy | Hazy |
| Heat 100° F./20 min. appearance | Clear | Hazy | Clear | Hazy |
| Cool to 50° F./Appearance | Clear | Hazy | Hazy | Hazy |
| % $H_2O$ by Karl Fischer Rg | 0.05 | — | 0.24 | — |

From the above Table the following may be noted:

(i) Example I shows that a synthetic diesel fuel containing 90 volumes of soy bean oil and 10 volumes of ethanol is hazy upon addition of 0.3 w % of water. This haze is eliminated by addition of 2,2-dimethoxy propane in molar amount in excess of the water present (mole ratio 1.036) in the presence of Amberlyst 15 acid catalyst.

(ii) Example II shows that in the absence of the acid resin catalyst, no clarification of the haze is effected.

(iii) Examples III–IV and V–VI show that by use of an amount of additive less than the amount of water present (mole ratio 0.689), no clarification is effected and the haze remains.

EXAMPLES VII–XIII

Results comparable to the above may be obtained if the additive, instead of being 2,2-dimethoxy propane, is as follows:

| EXAMPLE | ADDITIVE |
|---|---|
| VII | ethyl orthoformate |
| VIII | 2,2-diethoxy propane |
| IX | 1,1-dimethoxy ethane |
| X | 1,1-dimethoxy-n-butane |
| XI | 1,1-diethoxy-n-butane |
| XII | 2,2-dimethoxy-n-butane |
| XIII | 2,2-diethoxy-n-butane |

Results comparable to the above may be obtained if the vegetable oil composition is as follows:

| EXAMPLE | HYDROCARBON |
|---|---|
| XIV | Corn oil |
| XV | Cottonseed oil |
| XVI | Palm oil |
| XVII | Castor oil |

Although this invention has been illustrated by reference to specific embodiments, it will be apparent to those skilled in the art that various changes and modifications may be made which clearly fall within the scope of this invention.

I claim:

1. The method of stabilizing a composition containing an ethanol-miscible vegetable oil and a water-miscible alcohol which is miscible with said vegetable oil whereby said composition is inhibited from separating into more than one layer on contact with water which comprises mixing (i) said composition containing a vegetable oil and a water-miscible alcohol which is miscible with said vegetable oil, and (ii) as an additive, a ketal or an acetal or an orthoester thereby forming a stabilized composition of increased water-tolerance which remains a single phase mixture at pH below 7 in the presence of water; and recovering said stabilized composition of increased water-tolerance.

2. The method of stabilizing a composition containing an ethanol-miscible vegetable oil and a water-miscible alcohol which is miscible with said vegetable oil whereby said composition is inhibited from separating into more than one layer on contact with water as claimed in claim 1 wherein said alcohol is ethanol.

3. The method of stabilizing a composition containing an ethanol-miscible vegetable oil and a water-miscible alcohol which is miscible with said vegetable oil whereby said composition is inhibited from separating into more than one layer on contact with water as claimed in claim 1 wherein said alcohol is isopropanol.

4. The method of stabilizing a composition containing an ethanol-miscible vegetable oil and a water-miscible alcohol which is miscible with said vegetable oil whereby said composition is inhibited from separating into more than one layer on contact with water as claimed in claim 1 wherein additive is a ketal.

5. The method of stabilizing a composition containing an ethanol-miscible vegetable oil and a water-miscible alcohol which is miscible with said vegetable oil whereby said composition is inhibited from separating into more than one layer on contact with water as claimed in claim 1 wherein said additive is an acetal.

6. The method of stabilizing a composition containing an ethanol-miscible vegetable oil and a water-miscible alcohol which is miscible with said vegetable oil whereby said composition is inhibited from separating into more than one layer on contact with water as claimed in claim 1 wherein said ketal is 2,2-dimethoxy propane.

7. The method of stabilizing a composition containing an ethanol-miscible vegetable oil and a water-miscible alcohol which is miscible with said vegetable oil whereby said composition is inhibited from separating into more than one layer on contact with water as claimed in claim 1 wherein said ketal or acetal or orthoester is present in amount of 1 v %–25 v % of said composition.

8. The method of stabilizing a composition as claimed in claim 1 wherein said vegetable oil is soy bean oil.

9. The method of stabilizing a composition as claimed in claim 1 wherein said vegetable oil is corn oil.

10. The method of stabilizing a composition as claimed in claim 1 wherein said vegetable oil is peanut oil.

11. The method of stabilizing a composition as claimed in claim 1 wherein said vegetable oil is cottonseed oil.

12. The method of stabilizing a composition containing an ethanol-miscible vegetable oil and a water-miscible alcohol which is miscible with said vegetable oil whereby said composition is inhibited from separating into more than one layer on contact with water which comprises mixing at pH below 7 (i) said composition containing an ethanol-miscible vegetable oil and a water-miscible alcohol which is miscible with said vegetable oil, and (ii) as an additive a ketal or an acetal or an orthoester thereby forming a stabilized composition of increased water-tolerance; and recovering said stabilized composition of increased water-tolerance which remains a single phase mixture at pH below 7 in the presence of water.

13. The method of stabilizing a composition containing an ethanol-miscible vegetable oil and a water-miscible alcohol which is miscible with said vegetable oil whereby said composition is inhibited from separating into more than one layer on contact with water as claimed in claim 12 wherein mixing is effected in the presence of acid.

14. The method of stabilizing a composition containing an ethanol-miscible vegetable oil and a water-miscible alcohol which is miscible with said vegetable oil whereby said composition is inhibited from separating into more than one layer on contact with water as claimed in claim 12 wherein mixing is effected in the presence of sulfuric acid.

15. The method of stabilizing a composition containing an ethanol-miscible vegetable oil and ethanol or isopropanol or n-propanol whereby said composition is inhibited from separating into more than one layer on standing which comprises mixing at pH below 7, (i) said composition containing an ethanol-miscible vegetable oil and ethanol or isopropanol or n-propanol and (ii) as an additive a ketal or an acetal or an orthoester in amount of 1 v %–25 v % of said composition thereby forming a stabilized composition of increased water-tolerance; and recovering said stabilized composition of increased water-tolerance which remains a single phase mixture at pH below 7 in the presence of water.

16. The method of stabilizing a composition containing an ethanol-miscible vegetable oil, water, and a water-miscible alcohol which is miscible with said vegetable whereby said composition is inhibited from separating into more than one layer on standing which comprises mixing at pH below 7 (i) said composition containing an ethanol-miscible vegetable oil, water and a water-miscible alcohol which is miscible with said vegetable oil, and (ii) as additive a ketal, acetal or orthoester whereby said water is reacted with said ketal or acetal or orthoester thereby forming a stabilized composition of increased water-tolerance; and recovering said stabilized composition of increased water-tolerance.

17. The method of stabilizing a composition containing an ethanol-miscible vegetable oil, water, and a water-miscible alcohol which is miscible in the said vegetable oil whereby said composition is inhibited from separating into more than one layer on standing as claimed in claim 16 wherein said ethanol-miscible vegetable oil is soy bean oil.

18. The method of stabilizing a composition containing an ethanol-miscible vegetable oil, water, and a water-miscible alcohol which is miscible in the said vegetable oil whereby said composition is inhibited from separating into more than one layer on standing as claimed in claim 16 wherein said alcohol is methanol or isopropanol or n-propanol.

19. The method of stabilizing a composition containing an ethanol-miscible vegetable oil, water, and a water-miscible alcohol which is miscible in the said vegetable oil whereby said composition is inhibited from separating into more than one layer on standing as claimed in claim 16 wherein said ketal is 2,2-dimethoxy propane.

20. The method of stabilizing a composition containing an ethanol-miscible vegetable oil and a water-miscible alcohol which is miscible with said vegetable oil, and water whereby said composition is maintained in a single phase which comprises mixing (i) said composition containing an ethanol-miscible vegetable oil and a water-miscible alcohol which is miscible with said vegetable oil, and water, (ii) as an additive a ketal, acetal, or an orthoester, and (iii) a catalytic amount, sufficient to maintain the pH below 7 of an acid thereby forming a single phase stabilized composition.

21. The method claimed in claim 20 wherein said additive is present in amount at least equivalent to the water present in said composition.

22. The method of forming vegetable oil composition characterized by its ability to remain a single phase which comprises mixing (i) an ethanol-miscible vegetable oil, (ii) an aqueous solution of a water-miscible alcohol which is miscible with vegetable oil, and (iii) a ketal, an acetal, or an orthoester which reacts at pH below 7 with water which is present thereby forming a composition characterized by presence of a single phase; and recovering said single phase vegetable oil composition.

23. The method of forming a vegetable composition as claimed in claim 22 wherein said aqueous solution of a water-miscible alcohol is 95% ethanol.

24. The method of forming a vegetable oil composition as claimed in claim 22 wherein said pH is maintained by addition of acid.

25. The method of stabilizing a composition containing an ethanol-miscible vegetable oil, water, and ethanol or isopropanol or n-propanol whereby said composition is inhibited from separating into more than one layer on standing which comprises mixing at pH below 7 (i) said composition containing an ethanol-miscible vegetable oil, water and ethanol or isopropanol or n-propanol; and (ii) 2,2-dimethoxy propane whereby said water is reacted with said 2,2-dimethoxy propane thereby forming a stabilized composition of increased water-tolerance; and recovering said stabilized composition of increased water-tolerance.

26. A novel composition inhibited from separating into more than one layer on contact with water at pH below 7 which comprises 100 parts of an ethanol-miscible vegetable oil, 1–15 parts of a water-miscible alcohol which is miscible with said vegetable oil, and as additive 1–25 v % of a ketal, acetal, or an orthoester.

27. A novel composition as claimed in claim 26 wherein said vegetable oil is soy bean oil.

28. A novel composition as claimed in claim 26 wherein said alcohol is methanol or isopropanol or n-propanol.

29. A novel composition as claimed in claim 26 wherein said ketal is 2,2-dimethoxy propane.

30. A novel composition as claimed in claim 26 wherein said additive is an acetal.

31. A novel composition as claimed in claim 26 wherein said additive is an orthoester.

32. A novel composition containing soy bean oil, ethanol or methanol, and 2,2-dimethoxy propane.

33. A novel composition comprising 100 parts of an ethanol-miscible vegetable oil, 1–15 parts of a water-miscible alcohol which is miscible with said vegetable oil, and at least one reaction product of water and a ketal or an acetal or an orthoester.

34. The method of stabilizing a composition containing an ethanol-miscible vegetable oil and a water-miscible alcohol which is miscible with said vegetable oil whereby said composition is inhibited from separating into more than one layer on contact with water which comprises mixing (i) said composition containing a vegetable oil and a water-miscible alcohol which is miscible with said vegetable oil, and (ii) as an additive or orthoester thereby forming a stabilized composition of increased water-tolerance which remains a single phase mixture at pH below 7 in the presence of water; and recovering said stabilized composition of increased water-tolerance.

35. A novel composition inhibited from separating into more than one layer on contact with water at pH below 7 which comprises 100 parts of an ethanol-miscible vegetable oil, 1–15 parts of a water-miscible alcohol which is miscible with said vegetable oil, and as additive 1–25 v % of an orthoester.

* * * * *